US011430417B2

(12) United States Patent
Ota et al.

(10) Patent No.: US 11,430,417 B2
(45) Date of Patent: Aug. 30, 2022

(54) DATA GENERATION DEVICE AND NON-TRANSITORY COMPUTER-READABLE STORAGE MEDIUM

(71) Applicant: YAMAHA CORPORATION, Hamamatsu (JP)

(72) Inventors: Tetsuo Ota, Hamamatsu (JP); Yoshimasa Isozaki, Hamamatsu (JP); Yasuhiko Oba, Hamamatsu (JP); Tomoya Sasaki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 229 days.

(21) Appl. No.: 16/859,000

(22) Filed: Apr. 27, 2020

(65) Prior Publication Data

US 2020/0258485 A1 Aug. 13, 2020

Related U.S. Application Data

(63) Continuation of application No. PCT/JP2017/040129, filed on Nov. 7, 2017.

(51) Int. Cl.

| | |
|---|---|
| ***G10G 3/04*** | (2006.01) |
| ***G10G 1/04*** | (2006.01) |
| ***G10H 1/00*** | (2006.01) |

(52) U.S. Cl.

CPC ..... *G10G 3/04* (2013.01); *G10G 1/04* (2013.01); *G10H 1/0008* (2013.01); *G10H 2210/086* (2013.01)

(58) Field of Classification Search

CPC ..... G10G 3/04; G10G 1/04; G10H 1/0008; G10H 2210/086

(Continued)

(56) References Cited

U.S. PATENT DOCUMENTS 4,885,969 A * 12/1989 Chesters ..... G10H 1/32 84/478
5,254,804 A * 10/1993 Tamaki ..... G10F 1/02 84/626

(Continued)

FOREIGN PATENT DOCUMENTS

JP H04195196 A 7/1992
JP H04261591 A 9/1992

(Continued)

OTHER PUBLICATIONS

International Search Report issued in Intl. Appln. No PCT/JP2017/040129 dated Jan. 30, 2018. English translation provided.

(Continued)

*Primary Examiner* — Christina M Schreiber
(74) *Attorney, Agent, or Firm* — Rossi, Kimms & McDowell LLP

(57) ABSTRACT

A data generation device includes: an acquisition part configured to acquire measurement data that corresponds to measurement values, obtained in chronological order, corresponding to a behavior of a key or a member coordinating with the key for each of a plurality of keys; and a data generation part configured to generate display data for displaying a screen showing the measurement values corresponding to each of the plurality of keys along a time axis based on the acquired measurement data.

18 Claims, 7 Drawing Sheets

(58) Field of Classification Search
USPC ..... 84/609
See application file for complete search history.

(56) References Cited

U.S. PATENT DOCUMENTS

| | | | | |
|---|---|---|---|---|
| 5,367,117 | A * | 11/1994 | Kikuchi | G10H 1/0066 84/645 |
| 5,768,387 | A * | 6/1998 | Akiyama | G06F 21/316 705/72 |
| 7,291,779 | B2 * | 11/2007 | Hasebe | G10H 1/0008 84/649 |
| 7,507,899 | B2 * | 3/2009 | Sumita | G10G 3/04 84/649 |
| 8,541,677 | B2 * | 9/2013 | Smirnov | G10H 1/0025 84/609 |
| 8,907,195 | B1 * | 12/2014 | Erol | G10H 1/361 84/649 |
| 9,230,526 | B1 * | 1/2016 | Cook | G10H 1/0033 |
| 2005/0150362 | A1 * | 7/2005 | Uehara | G09B 15/08 84/645 |
| 2005/0204908 | A1 * | 9/2005 | Uehara | G10G 1/02 84/746 |
| 2005/0241462 | A1 * | 11/2005 | Hirano | G10H 1/0008 84/600 |
| 2008/0078281 | A1 * | 4/2008 | Katsuta | G09B 15/00 84/609 |
| 2011/0003638 | A1 * | 1/2011 | Lee | G10H 1/368 463/43 |
| 2015/0310876 | A1 * | 10/2015 | Kwan | G06F 21/10 700/94 |
| 2017/0287453 | A1 * | 10/2017 | Uemura | G10H 1/0008 |
| 2019/0103082 | A1 * | 4/2019 | Ogasawara | G10H 7/008 |
| 2020/0258485 | A1 * | 8/2020 | Ota | G10H 1/34 |

FOREIGN PATENT DOCUMENTS

| | | | | |
|---|---|---|---|---|
| JP | H096345 | A | 1/1997 | |
| JP | 2001265330 | A | 9/2001 | |
| JP | 2005265903 | A | 9/2005 | |
| JP | 2007033479 | A | 2/2007 | |
| JP | 2014186154 | A | 10/2014 | |
| JP | 6187132 | B2 | 8/2017 | |
| JP | 2017181724 | A | 10/2017 | |
| WO | WO-2019058942 | A1 * | 3/2019 | G06F 9/542 |

OTHER PUBLICATIONS

Written Opinion issued in Intl. Appln. No. PCT/JP2017/040129 dated Jan. 30, 2018.

English translation of Written Opinion issued in Intl. Appln. No. PCT/JP2017/040129 dated Jan. 30, 2018, previously cited in IDS filed Apr. 27, 2020.

* cited by examiner

DATA GENERATION DEVICE AND NON-TRANSITORY COMPUTER-READABLE STORAGE MEDIUM

CROSS-REFERENCE TO RELATED APPLICATIONS

This application is a U.S. continuation application filed under 35 U.S.C. § 111(a), of International Application No. PCT/JP2017/040129, filed on Nov. 7, 2017, the disclosures of which are incorporated by reference.

FIELD

The present invention relates to a technology for generating data according to performance of a piano.

BACKGROUND

There is a technology of recording performance of a piano with a sensor that measures a movement of a key. A method of representing the performance recorded like this by displaying an operated key is known. There is a method, in which, for example, in a region where a pitch of the key is defined in a vertical direction and a time axis is defined in a horizontal direction, by arranging a period (a period from key depression to key release) during which the key is operated in a belt-like image extending in the time axis direction, a performance content is displayed. This method is generally called as a "piano roll". For example, as disclosed in PTL 1 (Japanese Patent Application Laid-Open No. 2014-186154), various display methods that use the piano roll are studied.

SUMMARY

According to an embodiment of the present invention, a data generation device including: an acquisition part configured to acquire measurement data that corresponds to measurement values, obtained in chronological order, corresponding to a behavior of a key or a member coordinating with the key for each of a plurality of keys; and a data generation part configured to generate display data for displaying a screen showing the measurement values corresponding to each of the plurality of keys along a time axis based on the acquired measurement data is provided.

Furthermore, according to an embodiment of the present invention, a data generation device including: an acquisition part configured to acquire measurement data that corresponds to measurement values corresponding to a behavior of an operator; and a data generation part configured to generate display data for displaying a screen showing information related to a movement of a plurality of keys along a time axis based on the acquired measurement data, and the measurement values being shown along the time axis by a color change in a region corresponding to the plurality of keys is provided.

DESCRIPTION OF EMBODIMENTS

In what follows, with reference to the diagrams, a system in one embodiment of the present invention will be described in detail. An embodiment shown below is one example of embodiments of the present invention, the present invention is not construed by limiting to these embodiments. It should be noted that in the diagrams referred to in the present embodiment, a part or a part having the similar function are provided with the same sign or the similar sign (signs only provided with A or B after the number), and repetition of the description may be omitted.

Embodiment

[1. Outline of System]

Figure 1:
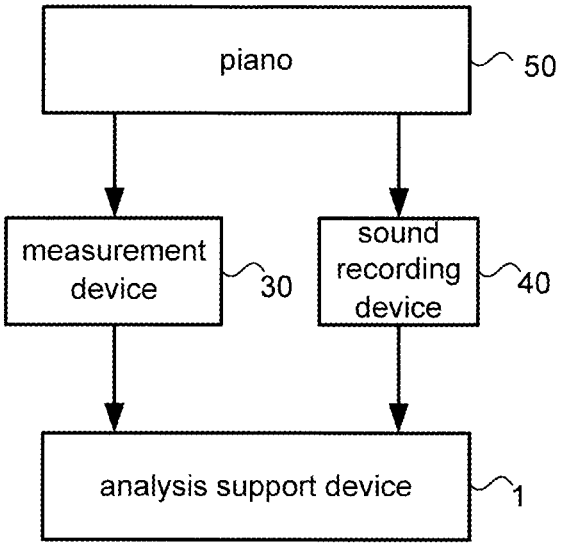
FIG. 1 is a diagram showing a constitution of a system in one embodiment of the present invention.

FIG. 1 is a diagram showing a constitution of a system in one embodiment of the present invention. This system includes an analysis support device 1, a measurement device 30, a sound recording device 40 and a piano 50. When a user plays the piano 50, a behavior of keys and pedals due to performance is measured by the measurement device 30. A measurement result is provided to the analysis support device 1. The sound recording device 40 is, for example, a microphone, and converts an input sound into an electric signal (sound signal). The sound recording device 40 may be provided with a memory that records the sound signal. A performance sound input into the sound recording device 40 is provided to the analysis support device 1. The analysis support device 1 offers information entered to a user via information output means such as a display and a speaker.

Information when piano performance is recorded is, for example, an operated key, a key depression timing and a key release timing. In a general piano roll display, these of information are used. However, these of information have a very small amount of information compared with an actual performance. According to the piano roll display like this, while a rough performance content may be visually recognized, a fine performance content may not be recognized. Therefore, even if a player intends to improve a playing technique by analyzing own performance, in one that uses the general piano roll display, an amount of information was insufficient.

According to the present invention, while using a region defined by a pitch of a key and a time axis like the piano roll display, a larger amount of information may be represented. In what follows, each of constitutions of the system will be described in detail.

[2. Piano]

A piano 50 is a general ground piano in this example. It should be noted that the piano 50 may be an acoustic piano other than the ground piano. Furthermore, the piano 50 may be an electronic musical instrument such as an electronic piano without limiting to the acoustic piano. In this example, in the piano 50, a part of the measurement device 30 is installed.

Figure 2:
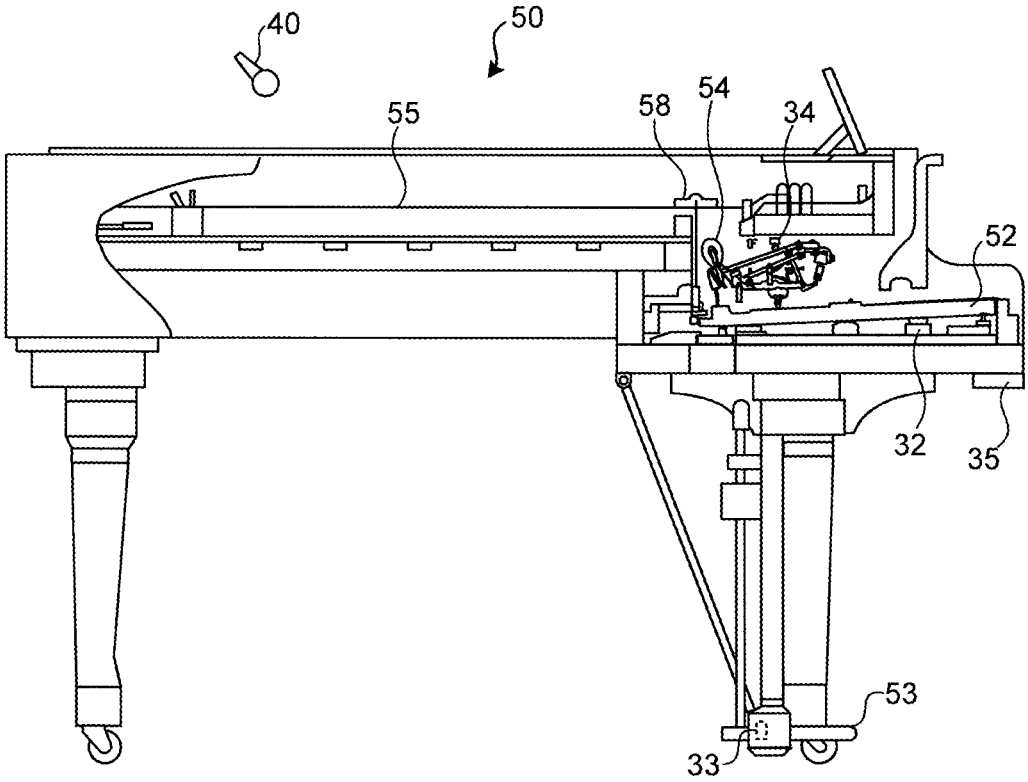
FIG. 2 is a diagram showing a structure of a piano in one embodiment of the present invention.

FIG. 2 is a diagram showing a structure of a piano in one embodiment of the present invention. The piano 50 is one example of a keyboard instrument having, on a front surface thereof, a keyboard in which a plurality of keys 52 operated by a player are arranged, and pedals 53. In this example, although there are a plurality of pedals 53, at least a damper pedal is included. A hammer 54 is provided in response to each of keys 52. The hammer 54 is a member coordinating with the key 52, and moves when the key 52 is depressed and a force is transmitted via an action mechanism to hit a string 55 provided corresponding to each of keys 52. The string 55 produces a sound by the impact from the hammer 54.

A damper 58 is moved by a damper operating mechanism. The damper operating mechanism moves the damper 58 such that a contact state of the damper 58 and the string 55 is controlled according to a depression amount of the key 52, and a stepping amount of pedal 53.

[3. Measurement Device]

Figure 3:
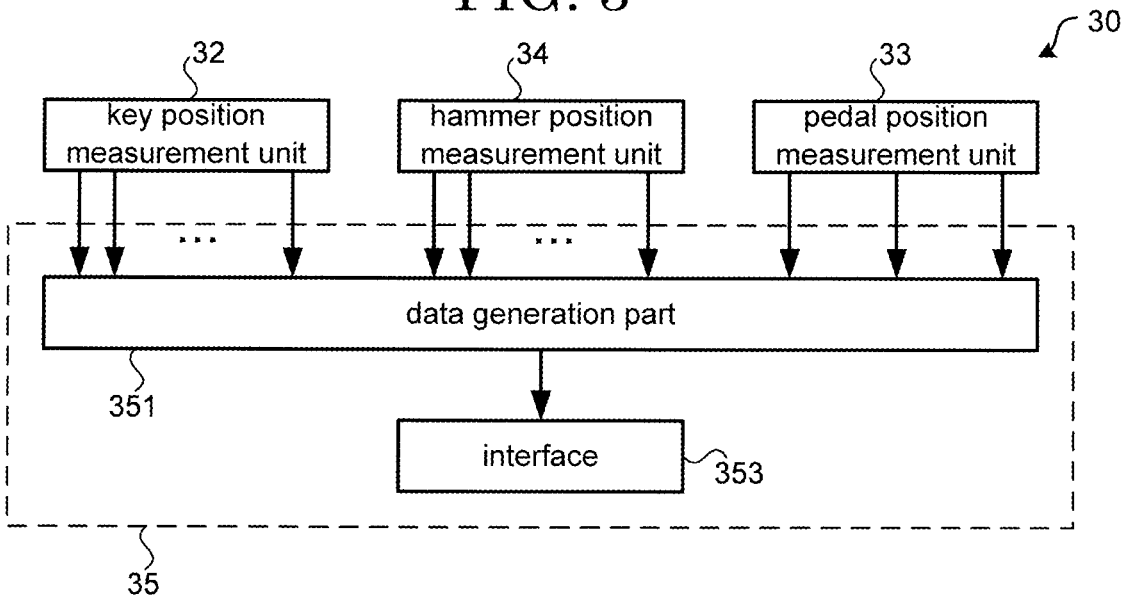
FIG. 3 is a block diagram showing a constitution of a measurement device in one embodiment of the present invention.

FIG. 3 is a block diagram showing a constitution of the measurement device in one embodiment of the present invention. As was described above, in the piano 50, a part of the measurement device 30 is installed. In what follows, with reference to FIG. 2 and FIG. 3, the measurement device 30 will be described. The measurement device 30 includes a key position measurement unit 32, a pedal position measurement unit 33, a hammer position measurement unit 34 and a data output device 35.

The key position measurement unit 32 includes key sensors provided corresponding to each of the keys 52. The key position measurement unit 32 measures a position (corresponding to depression amount) of each of the keys 52 by the key sensor as a continuous amount (fine resolution), and outputs a measurement value showing a measurement result (hereinafter, in some cases, referred to as "a key position measurement value"). The measurement value is output corresponding to each of the keys 52. It should be noted that the key sensor may output a measurement value showing that the key 52 passed a specific depression position instead of outputting the measurement value corresponding to the position of the key 52. The specific depression positions are a plurality of positions within from a rest position of the key 52 to an end position. The plurality of positions may be a position that gives a change to a sound production state such as sound production start, damping start. Like this, the measurement value that the key position measurement unit 32 outputs may be information showing a behavior of the key 52.

The pedal position measurement unit 33 includes pedal sensors provided corresponding to each of the pedals 53. The pedal position measurement unit 33 measures a position (corresponding to a stepping amount) of each of the pedals 53 with the pedal sensor as a continuous amount (fine resolution), and outputs a measurement value (hereinafter, in some cases, referred to as "pedal position measurement value) showing a measurement result. This measurement value is output corresponding to each of the pedals 53. It should be noted that the pedal sensor may output a measurement value showing that the pedal 53 passed a specific position instead of outputting the measurement value corresponding to the position of the pedal 53. The specific positions are a plurality of positions contained within a movable range of the pedal. Thus, the measurement values output by the pedal position measurement unit 33 may be information showing a behavior of the pedal 53. In the following description, when referring to the pedal 53, the description means the damper pedal. Accordingly, the pedal position measurement value corresponds to a position of the damper pedal (stepping amount).

The hammer position measurement unit 34 includes a hammer sensor provided corresponding to each of the hammers 54. The hammer position measurement unit 34 measures a position (corresponding to a movement amount) of each of the hammers 54 with the hammer sensor as a continuous amount (fine resolution), and outputs a measurement value (hereinafter, in some cases, referred to as "hammer position measurement value) showing a measurement result. This measurement value is output corresponding to each of the hammers 54. It should be noted that the hammer sensor may output a measurement value showing that the hammer 54 passed a specific position instead of outputting the measurement value corresponding to the position of the hammer 54. The specific positions are a plurality of positions contained within a movable range of the hammer. Thus, the measurement values output by the hammer position measurement unit 34 may be information showing a behavior of the hammer 54.

The data output device 35 is provided, for example, on the lower side of a keybed of the piano 50. The data output device 35 includes a data generation part 351 and an interface 353, and, based on the information output from the key position measurement unit 32, the pedal position measurement unit 33 and the hammer position measurement unit 34, measurement data and control data are generated and output.

The data generation part 351 generates measurement data and control data based on the information output from the key position measurement unit 32, the pedal position measurement unit 33 and the hammer position measurement unit 34. The measurement data includes the key position measurement values corresponding to each of the keys 52, the hammer position measurement values corresponding to each of hammers 54, and the pedal position measurement value corresponding to the pedal 53 (damper pedal). The control data is data obtained by converting from each of the measurement values to a predetermined data form (for example, MIDI form) that defines chronologically a sound production content. The control data contains data such as note number, note-on, note-off, velocity (on-velocity (key speed at the time of note-on), off-velocity (key speed at the time of note-off)) and control change (stepping amount of the pedal).

The interface 353 has a constitution for transmitting and receiving data by externally connecting by wires or wirelessly. To the external device connected with the interface 353, measurement data and control data generated by the data generation part 351 are output. The external device may be a device capable of arithmetically processing or a recording medium such as a semiconductor memory. In this example, the external device includes the analysis support device 1. It should be noted that the measurement data and the control data may be output to the external device in real time or may be output to the external device after being stored as chronological information together with time information in a memory. Anyway, the measurement data and the control data include chronologically arranged information.

For example, the measurement data are the data showing each of measurement value chronologically. What was described above is a description of the measurement device 30.

[4. Analysis Support Device]

The analysis support device 1 generates information for supporting an analysis of a performance content of a user based on the information output from the measurement device 30. In functions realized in the analysis support device 1, a function (analysis support function) of generating display data for displaying a detail (hereinafter, in some cases, referred to as "an analysis support screen") of a performance content of a user on a display (a display unit 17 described below) is included. The analysis support device 1 may be said to be a data generating device of generating data for displaying the analysis support screen like this.

[4-1. Hardware Constitution of Analysis Support Device]

Figure 4:
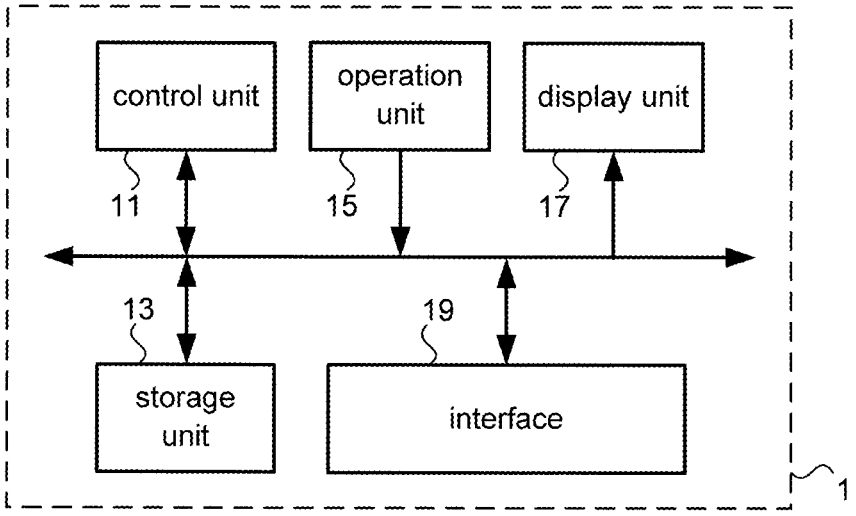
FIG. 4 is a block diagram showing a hardware constitution of an analysis support device in one embodiment of the present invention.

FIG. 4 is a block diagram showing a hardware constitution of the analysis support device in one embodiment of the present invention. The analysis support device 1 is a device capable of realizing a predetermined function by executing a program in, for example, a personal computer. The analysis support device 1 includes a control unit 11, a storage unit 13, an operation unit 15, a display unit 17, and an interface 19. These constitutions are connected via a bus.

The control unit 11 includes an arithmetic processing circuit such as a CPU. The control unit 11 realizes various kinds of functions in the analysis support device 1 by executing a control program stored in the storage unit 13 by the CPU. Functions that are realized include the analysis support functions described above.

The storage unit 13 is a memory device such as a nonvolatile memory or a hard disc. The storage unit 13 stores a control program for realizing the analysis support functions. The control program may be one capable of executing by the computer, and may be provided in a state stored in a recording medium capable of reading by the computer such as a magnetic recording medium, an optical recording medium, a magneto-optical recording medium, and a semiconductor memory. In this case, the analysis support device 1 may be provided with a device that reads the recording medium. Furthermore, the control program may be downloaded via a network.

The storage unit 13 may store the measurement data acquired from the measurement device 30 and the control data. Furthermore, the storage unit 13 stores musical score data of various music. The musical score data shows, for example, a sound production content of music, and is data capable of showing also as the musical score. It should be noted that each data may be stored in an external memory device (server, recording medium) connectable by wires or wirelessly, instead of storing in the storage unit 13.

The operation unit 15 is an input device such as an operation button, a keyboard, and a mouse, which are provided on an operation panel and a remote controller, and outputs a signal corresponding to an input operation to the control unit 11. By the operation unit 15, a user instruction may be input into the analysis support device 1.

The display unit 17 is a display device such as a liquid crystal display or an organic EL display, and displays a screen based on the control by the control unit 11. The display data generated by the analysis support function is displayed on this screen. It should be noted that the operation unit 15 and display unit 17 may together form a touch panel.

The interface 19 has a constitution of transmitting or receiving data by connecting with the external device by wires or wirelessly. The measurement data and control data generated in the measurement device 30 are acquired by the analysis support device 1 via the interface 19. Furthermore, a sound signal or the like generated in the recording device 40 is also acquired by the analysis support device 1 via the interface 19. Furthermore, a sound output device such as a speaker may be connected to the interface 19. In this case, by supplying the sound signal to the speaker from the analysis support device 1, the sound may be reproduced by the speaker.

[4-2. Software Constitution of Analysis Support Device]

An analysis support function realized when the control unit 11 of the analysis support device 1 executes the control program will be described. It should be noted that a part or a whole of the constitution that realizes the analysis support function described below may be realized by the hardware.

Figure 5:
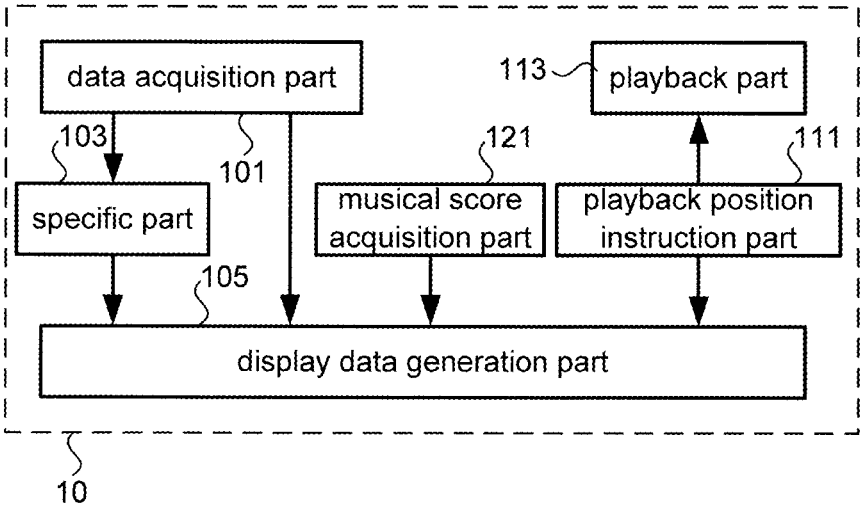
FIG. 5 is a block diagram showing a constitution of an analysis support function in one embodiment of the present invention.

FIG. 5 is a block diagram showing a constitution of the analysis support function in one embodiment of the present invention. The analysis support function 10 includes a data acquisition part 101, a specific part 103, a display data generation part 105, a playback position instruction part 111, a playback part 113, and a musical score acquisition part 121.

The data acquisition part 101 acquires the measurement data and the control data from the measurement device 30. Furthermore, in the example, the data acquisition part 101 acquires a sound signal from the recording device 40.

The specific part 103 specifies a period until note-on and note-off, that is, a period from the key depression to the key release (hereinafter, in some cases, referred to as "a key depression period") to each of the keys based on the control data that the data acquisition part 101 acquired. As was described above, the control data is the data generated by the measurement device 30 based on the measurement value. Therefore, the specific part 103 may be said to specify the key depression period based on the measurement value.

A music score acquisition part 121 acquires music score data of a music appointed by a user from the storage unit 13. The music score acquisition part 121 analyzes the control data acquired from the measurement device 30 or a sound signal acquired from the recording device 40, compares with a plurality of pieces of musical score data stored in the storage unit 13 and may acquire musical score data corresponding to a most similar music.

The display data generation part 105 generates display data for displaying an analysis support screen on the display unit 17 based on various kinds of information such as measurement data, control data and musical score data. The display data are stored in the storage unit 13. The control unit 11 makes display the analysis support screen on the display unit 17 based on the display data.

Figure 6:
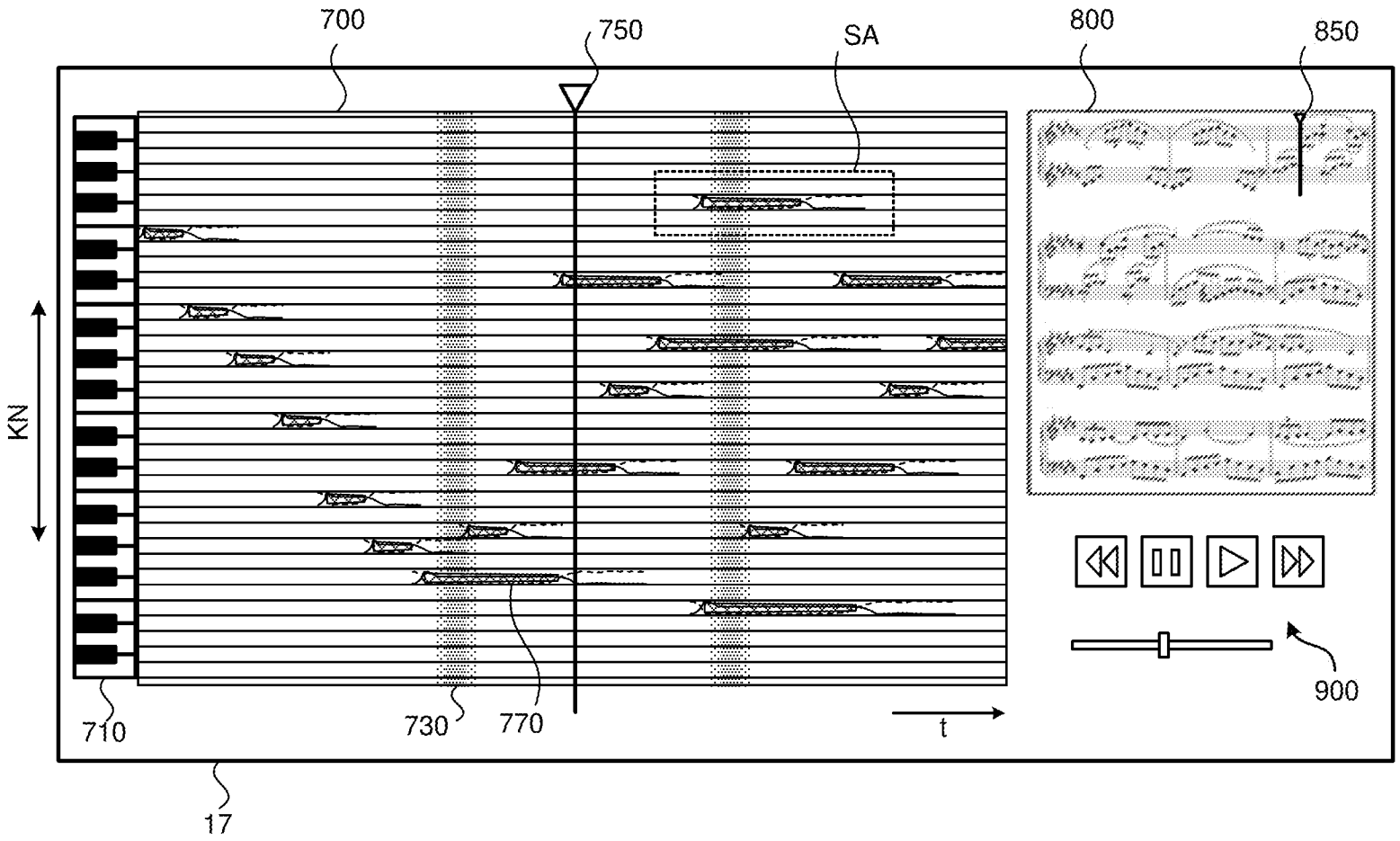
FIG. 6 is a diagram showing one example of an analysis support screen in one embodiment of the present invention.

FIG. 6 is a diagram showing one example of the analysis support screen in one embodiment of the present invention. The analysis support screen includes, in the example, a performance result region 700, a musical score region 800 and a control icon region 900.

The performance result region 700 is a region that, in the same manner as a so-called piano roll display, in a region where a pitch (corresponding to a note number) KN of a key is defined in a vertical direction and a point of time t is defined in a horizontal direction, displays an image corresponding to the performance content. In a vertical direction, a keyboard image 710 showing an arrangement of keys corresponding to a pitch is displayed. It should be noted that in the performance result region 700, a period of a part of an entire performed period is displayed, by scroll displaying in a direction along a time axis, a range of the displayed period may be varied.

Here, according to a general piano roll display, in many cases, a key depression period is expressed by a belt-like image. On the other hand, in the present example, instead of simply displaying a performance result with a belt-like image, the performance content may be grasped in more detail by a key behavior image 770. Furthermore, in this example, the pedal behavior is also displayed as a pedal behavior image 730 in the same region as a region where the key behavior image 770 is displayed. The key behavior image 770 and pedal behavior image 730 are images that vary based on the measurement data and control data. These images will be described in more detail below.

In the performance result region 700, an enlarged display may be performed by specifying a specific range. For example, by specifying a region SA shown in FIG. 6, the region SA may be expanded and displayed so as to overlap with a region of a part of the display unit 17 (for example, a display shown in FIG. 7).

In the performance result region 700, an instruction image 750 (first instruction image) that shows a playback position is displayed. The instruction image 750 is an image for instructing a position on a time axis in the performance result region 700.

The musical score region 800 is a region displaying a musical score based on musical score data acquired by the musical score acquisition part 121. In the musical score region 800, an instruction image 850 (second instruction image) that shows a playback position is displayed. The instruction image 850 is an image of instructing a position on the musical score. The position on the musical score corresponds to a position on a time axis that the instruction image 750 instructs. Accordingly, when a position instructed by the instruction image 750 varies, a position on the musical score which is instructed by the instruction image 850 also varies. It should be noted that the musical score region 800 may not be present.

A position on the time axis in the performance result region 700 and a position on the musical score in the musical score region 800 are associated by a so-called score-alignment technique. The score-alignment technique is a technique that analyzes a performance content (measurement data, control data or sound signal) and associates a time axis of the performance content and a time axis of the sound production content of the predetermined music. For example, by associating each of sounds in the performance content and an each of sounds in the sound production content of the music, even if there is fluctuation in a performance speed, which part of the music is performed may be specified. At this time, by using the musical score data, via a correspondence relation between the performance and the music, a position on the time axis of the performance content and a position on an image of the musical score may be also associated. Although, in the technique like this, known various techniques may be applied, techniques disclosed in, for example, Japanese Patent Application Laid-Open No. 2017-181724 and Japanese Patent No. 6187132 may be used.

A control icon region 900 is a region where a plurality of icons that receive user operation are displayed. By these icons, the user may change a position (a position on a time axis in the performance result region 700) instructed by an instruction image 750. In this example, four icons are displayed. These icons receive, sequentially from the left side, a quick return, a momentary pause, a playback start, and a fast forward.

Returning to FIG. 5, the description will be continued. The playback position instruction part 111 appoints a position on the time axis in the performance result region 700 corresponding to an operation to the icons in a control icon region 900. For example, when the playback start is appointed by the icon, from a position appointed at that time point, as the time goes, a position to be appointed is forwarded. The playback position specification part 111 outputs an appointed position to the playback part 113 as the playback position. At this time, the instruction image 750 and instruction image 850 change a position appointed according to the playback position.

The playback part 113 playbacks a sound signal acquired from the sound recording device 40 when an instruction of the playback start is received by an operation to the icon in the control icon region 900. A position on the time axis to playback is a playback position instructed by the playback position instruction part 111. At this time, in place of playback of a sound signal, the sound based on the control data may be reproduced with a sound source. Thus, both the sound signal and control data may be said to be sound production data that defines chronologically the content of the sound to be reproduced (produced sound). What was described above is a description of a constitution of the analysis support function.

[4-3. Key Behavior Image]

Subsequently, a key behavior image 770 in the performance result region 700 will be detailed. Here, a description will be provided with FIG. 7 that is an example when the region SA is shown by expanding.

Figure 7:
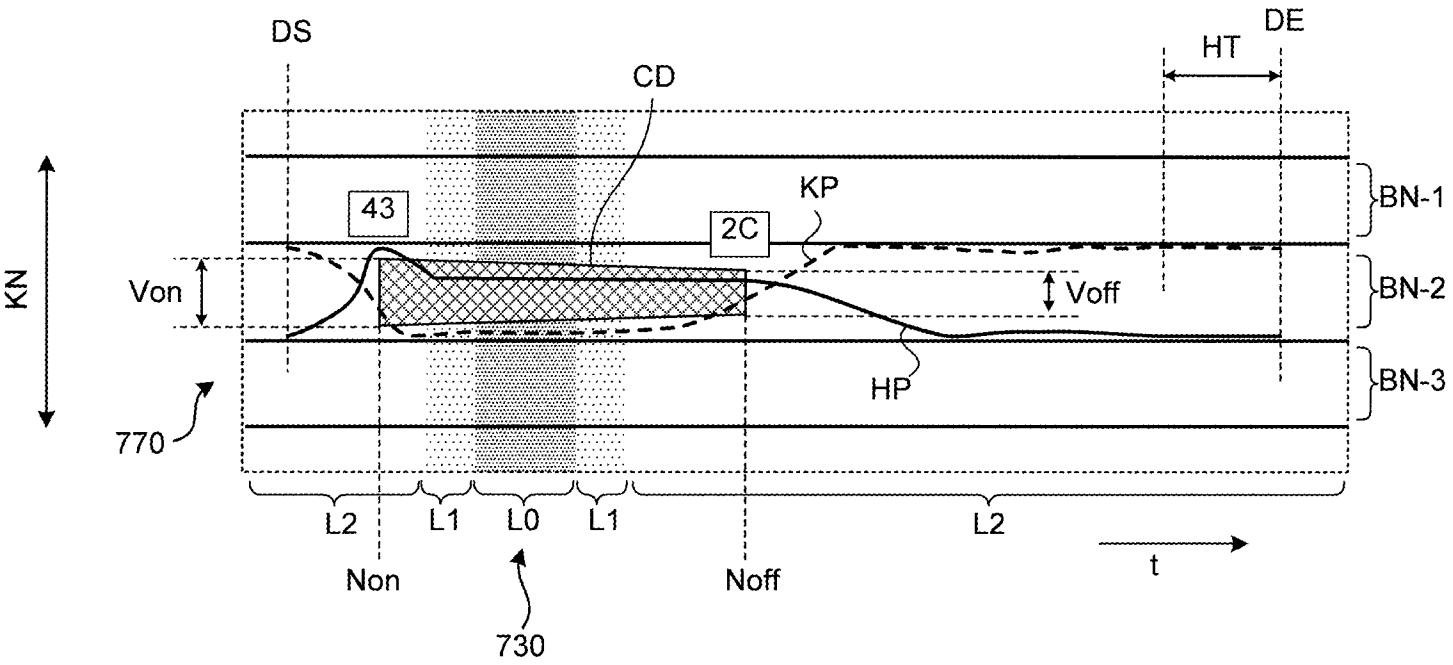
FIG. 7 is a diagram showing one example of a key behavior image in one embodiment of the present invention.

FIG. 7 is a diagram showing one example of a key behavior image in one embodiment of the present invention. As shown in FIG. 7, corresponding to a pitch KN of each of keys, regions BN partitioned in belt (BN-1, BN-2, BN-3) are arranged. The key behavior image 770 corresponding to a key of each pitch is displayed in a region BN (a region BN-2 in this example) partitioned corresponding to the key. The key behavior image 770 includes, in this example, a belt-like image CD, a key position image KP and a hammer position image HP. The belt-like image CD is an image displayed with a predetermined width along a partition of the region BN. Both of the key position image KP and hammer position image HP are images expressed in line and are desirably different shapes capable of differentiating from each other. In this example, by a dotted line (a key position image KP) and a solid line (a hammer position image HP), different forms are shown. As the different form, difference of line breadth, difference of a color of the line are illustrated.

The belt-like image CD is displayed based on the control data. A range in a lateral direction (a point of time t direction: a time axis direction) of the belt-like image CD is defined by a range from a point of time of note on Non to a point of time of note off Noff, that is, by the key depression period. A vertical direction (a pitch KN direction) of the belt-like image CD has a length according to a magnitude of an on-velocity Von at a position of the note-on Non and has a length according to a magnitude of an off-velocity Voff at a position of note-off Noff. This length may be expressed as an occupancy in a width direction of the region BN. The belt-like image CD becomes a trapezoidal form when the on-velocity Von and the off-velocity Voff are different. Like an example shown in FIG. 7, a value of the on-velocity Von may be displayed in the neighborhood of a position of the note-on Non. Furthermore, a value of the off-velocity Voff may be displayed in the neighborhood of a position of the note-off Noff. In this example, a value "43" of the on-velocity Von and a value "2C" of the off-velocity Voff are hexadecimally coded.

The key position image KP (dotted line) is displayed based on a measurement value corresponding to each key shown by the measurement data. The key position image KP is an image showing a position (a depression amount) corresponding to the region BN. A position of the key at each time t corresponds to a vertical direction (a pitch KN direction) in the region BN. In this example, among the region BN, in a side where a pitch is high (a region BN-1 side in a region BN-2), the key is shown in a rest position (a position that is not depressed). On the other hand, on a side where the pitch is low, the key is shown at an end position (a completely depressed position). A start point DS of the key position image KP corresponds to a point of time when a key depression is started. The end point DE of the key position image KP corresponds to a point of time when a constant time HT has passed after the key stopped at the rest position. Thereby, a user may confirm a movement of the key from the key depression to the key release (a point of time after passing a little from the key release).

The hammer position image HP (a solid line) is displayed based on a measurement value corresponding to each hammer shown by the measurement data. The hammer position image HP is an image showing a position of a hammer (a movement amount) coordinating with the key corresponding to the region BN. A position of the hammer at each time t corresponds to a vertical direction of the region BN. In this example, among the region BN, on a side where the pitch is low, the hammer is at a standard position (a position of the hammer when the key is not depressed). On the other hand, on a side where the pitch is high, the hammer is located at a position where the hammer strikes a string. The hammer position image HP is displayed in the range corresponding to the above start point DS to the end point DE. Thus, a user may confirm a movement of the hammer from the key depression to key release (a point of time after passing a little from the key release). It should be noted that any one or both of the start point DS and the end point DE may be determined based on a movement of the hammer.

As was described above, the key position image KP and hammer position image HP do not show measurement values corresponding to an entire period but show measurement values obtained by extracting a range of a part on the time axis.

By displaying by extracting a part of the data like this, the visibility in the performance result region 700 is improved. A method of displaying by extracting the data like this will be described in the description of the analysis support process described below.

[4-4. Pedal Behavior Image]

Subsequently, the pedal behavior image 730 will be described. The pedal behavior image 730 is displayed based on a measurement value corresponding to a pedal that the measurement data show. The pedal behavior image 730 is an image corresponding to a position (a stepping amount) of the pedal and, measurement values at each time are displayed by extending over a plurality of regions BN. In this example, measurement values at each time are displayed in all of the region BN displayed in the performance result region 700. At this time, the pedal behavior image 730 expresses measurement values by a color change. In an example shown in FIG. 7, each of regions L0, L1 and L2 is expressed by a different color. The region L0 shows a period during which the pedal is at a rest position (a state where the pedal is not stepped). On the other hand, the region L2 shows a period during which the pedal is at an end position (a state where the pedal is completely stepped). The region L1 shows a period during which the pedal is at a position between the rest position and the end position.

The color change in the pedal behavior image 730 exemplifies at least one or a change of a plurality of combinations of a color, a saturation and brightness. It should be noted that in a state where the pedal is at a rest position, the color may be made the same as the background of the performance result region 700. In this case, the color change may be caused such that the pedal behavior image 730 substantially changes the transmittance.

Figure 8:
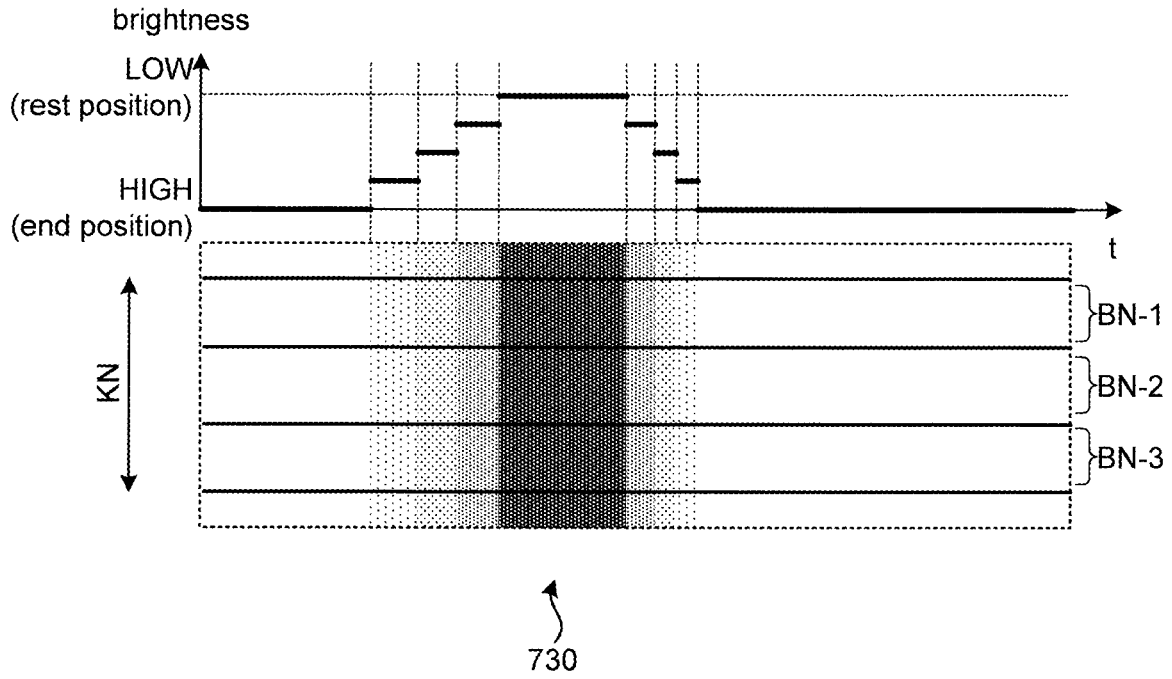
FIG. 8 is a diagram showing one example of a pedal behavior image in one embodiment of the present invention.

FIG. 8 is a diagram showing one example of the pedal behavior image in one embodiment of the present invention. In FIG. 8, a color change of the pedal behavior image 730 is more easily understandably described. In FIG. 7, when the pedal is located between the rest position and the end position, although the region L1 is displayed by one step of brightness, in FIG. 8, an example displayed by 3 steps is displayed. Thus, the position of the pedal is shown in more detail. In a graph where a time axis is shown in a lateral direction and the brightness is shown in a vertical direction, a temporal change of the color (brightness) of the pedal behavior image 730 is shown. In this example, the closer to the rest position the pedal is, the lower the brightness is, and the closer to the end position the pedal is, the higher the brightness is. In an example of FIG. 8, in a state where the pedal was stepped, a state further stepped after once returning is shown. According to this example, also when the pedal is returned, the color change is faster when the pedal is again stepped (the color change is abrupt).

It should be noted that the brightness may be displayed by differentiating in more steps. At this time, the resolution of the pedal position measurement value and the resolution (corresponding to the number of steps) of the brightness contained in the measurement data may be set equal or different. In this case, the pedal position measurement value may be converted to each of the steps of the brightness according to a predetermined calculation method.

[4-5. Analysis Support Process]

An analysis support treatment executed by the analysis support function 10 will be described with reference to FIG. 9. The analysis support process is started by an instruction of a user.

Figure 9:
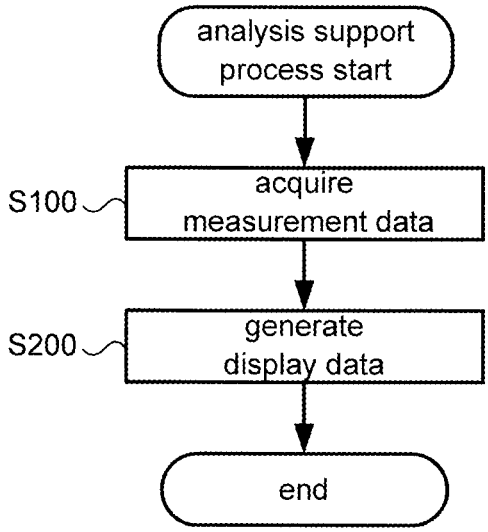
FIG. 9 is a flow-chart for explaining an analysis support process in one embodiment of the present invention.

FIG. 9 is a flow-chart for describing the analysis support process in one embodiment of the present invention. The control unit 11 acquires measurement data obtained by the measurement device 30 (step S100). The measurement data acquired here contains first measurement data showing chronologically key position measurement values and hammer position measurement values, and second measurement data showing chronologically pedal position measurement values. It should be noted that in this example, also the control data are acquired. Furthermore, a sound signal is acquired from the sound recording device 40.

Subsequently, the control unit 11 generates display data for displaying the analysis support screen (step S200), based on each of acquired information. As was described above, the analysis support screen contains at least the performance result region 700. The performance result region 700 is a region where measurement values corresponding to each of the keys are displayed along a time axis as the key behavior image 770. Furthermore, the key behavior image 770 corresponding to a plurality of keys are displayed along the same time axis. At this time, measurement values in the range of a part on the time axis among an entire duration are displayed as the key behavior image 770. Subsequently, among processes that generate the display data, a drawing process for displaying the key position image KP and the hammer position image HP will be described.

[4-6. Drawing Process of Key Position Image KP and Hammer Position Image HP]

Figure 10:
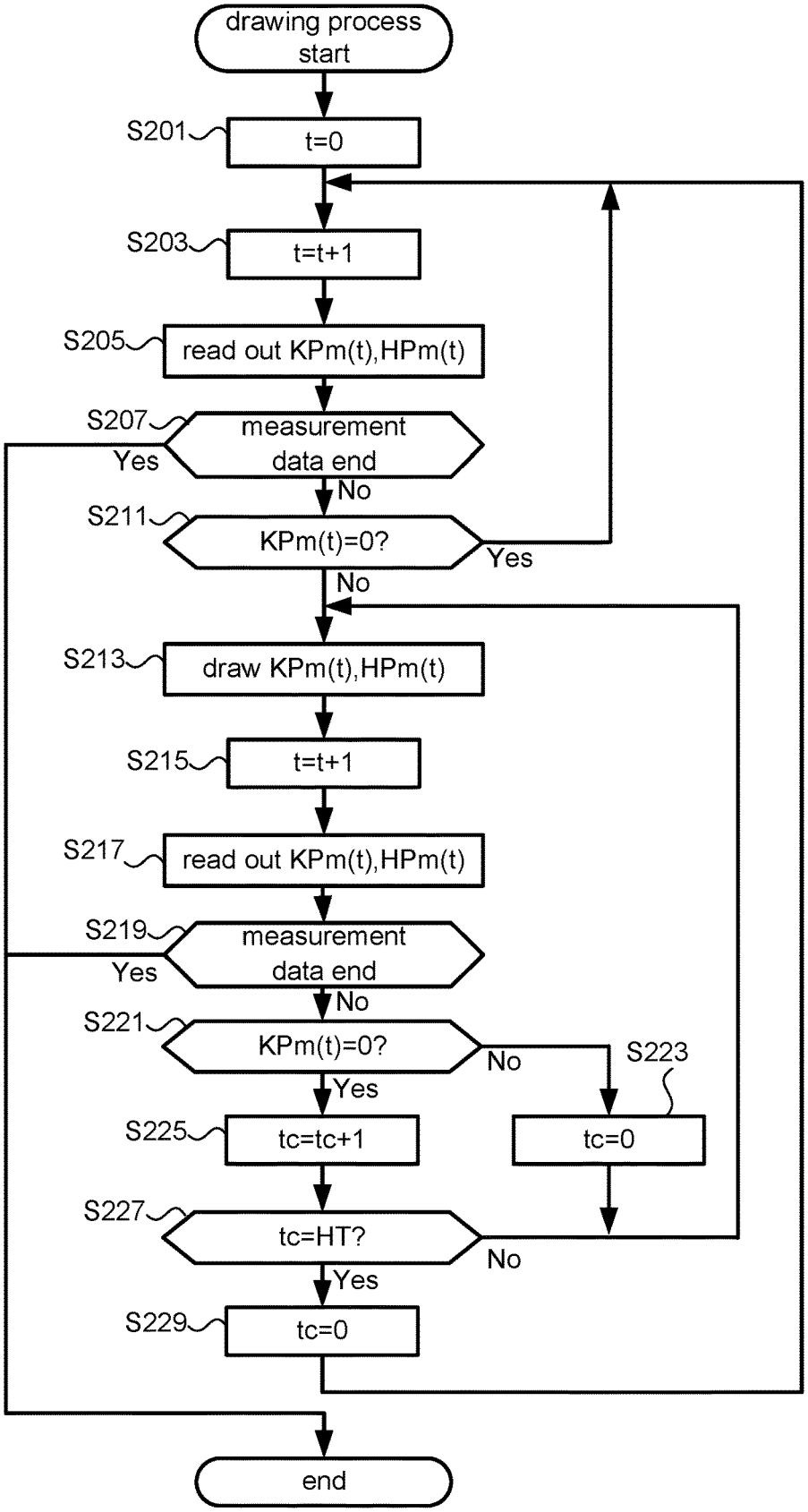
FIG. 10 is a flow-chart for explaining a drawing process in one embodiment of the present invention.

FIG. 10 is a flowchart for describing a drawing process in one embodiment of the present invention. The drawing process is executed corresponding to each of the keys. First, the control unit 11 initializes to a point of time t=0 (step S201), and proceeds the t to t=t+1 (step S203). The control unit 11 reads out a key position measurement value KPm (t) at the time t and a hammer position measurement value HPm (t) at the time t from the measurement data (step S205). At this time, when KPm (t) exceeds the last data and the measurement data ends (step S207; Yes), the control unit 11 ends the drawing process. On the other hand, when the measurement data does not end (step S207; No), the control unit 11 determines whether KPm (t)=0 (the key is at a rest position) or not (step S211). When KPm (t)=0 (step S211; Yes), the control unit 11 returns to the step S203 and proceeds a process.

In the case where KPm (t) is not 0 (step S211; No), the control unit 11 draws KPm (t) and HPm (t) at a position corresponding to a point of time t of the region BN corresponding to a target key (step S213). The control unit 11 proceeds the point of time t to t=t+1 (step S215). The control unit 11 reads out a key position measurement value KPm (t) and a hammer position measurement value HPm (t) from the measurement data (step S217). At this time, when the KPm (t) exceeds the last data and the measurement data ends (step S219; Yes), the control unit 11 ends the drawing process. On the other hand, when the measurement data does not end (step S219; No), the control unit 11 determines whether KPm (t) is 0 or not (step S221). When the KPm (t) is not 0 (step S221; No), the control unit 11 sets a holding time to t c=0 (step S223), returns to the step S213 and proceeds a process. By repeating the process, the key position image KP and the hammer position image HP are drawn.

In the case of KPm (t)=0 (step S221; Yes), the control unit 11 proceeds the tc to tc=tc+1 (step S225), and determines whether tc=HT or not (step S227). This HT corresponds the constant time HT described in FIG. 7. In the case where tc is not HT (step S227; No), the control unit 11 returns to the step S213 and proceeds the process. In the case of tc=HT (step S227; Yes), the control unit 11 initializes to tc=0 (step S229), returns to the step S203 and proceeds the process. By performing like this, when the KPm (t)=0 continues until reaching tc=HT, until a state where KPm(t) is not 0 is reached, that is, until the key is pressed next time, the drawing of the key position image KP and the hammer position image HP is stopped. That is, the key position measurement value and the hammer position measurement value are partially extracted on the time axis and displayed on the performance result region 700 as the key position image KP and the hammer position image HP. What was described above is a description of the drawing process.

It should be noted that due to the drawing process like this, when a user applies a first key depression, followed by key release, furthermore, immediately followed by second key depression, the first key depression and the second key depression may be integrated as one key behavior image 770 (the key position image KP and the hammer position image HP). In this case, since a key depression period exists as two durations, in one key behavior image 770, although the key position image KP and the hammer position image HP are one respectively, two belt-like images CD are present. For example, in the case of a performance method where a key is stricken repeatedly, many belt-like images CD are present in one key behavior image 770.

[5. Content of Analysis Support]

According to the analysis support device 1, in an analysis support screen (in particular, the performance result region 700), the following analysis supports may be provided to users.

(1) According to the key position image KP and the hammer position image HP, when there was a performance (key depression operation) that uses keys separated in pitch, because these are displayed on the same time axis, details of key depression operations to mutual keys may be readily compared. For example, in a melody and an accompaniment, at what timing the keys are depressed can be readily compared.

(2) According to the key position image KP and the hammer position image HP, a relation between a movement of a key and a movement of a hammer coordinating with the key may be readily confirmed. Thus, a correlation of the behavior of the hammer to the key depression method (large or small key depression amount, strong or weak, or repeated strike) may be readily confirmed.

(3) According to the pedal behavior image 730, because it is displayed spreading over the region BN corresponding to a plurality of keys, a key of any pitch, due to the relation with the key position image KP, may be readily confirmed about a positional relationship on a time axis of a key depression timing and a timing when the pedal is stepped. At this time, by playbacking a sound signal, the sound turbidity is also confirmed.

(4) Whether there is the same tendency in the method of key depression in the similar phrase, or whether there is a particular habit when depressing the key with the same finger may be readily confirmed. At this time, by confirming the display in the musical score region 800, a part having similar phrase may be readily confirmed.

MODIFICATION EXAMPLE

In the above, although one embodiment of the present invention was described, one embodiment of the present invention may be modified to various forms as shown below. Furthermore, modified examples described below may be applied by variously combining with each other.

(1) In the performance result region 700 in the above embodiment, an image (or an image obtained by modifying the waveform) showing a waveform of a sound signal acquired from a sound recording device 40 may be displayed on the same time axis.

(2) In the performance result region 700 in the above embodiment, the pedal behavior image 730 may not be displayed.

(3) In the performance result region 700 in the above embodiment, the key behavior image 770 may not be displayed. In this case, in a region where the pedal behavior image 730 is displayed, a piano roll display such as the conventional technique, that is, an image that shows a key depression period to each of keys may be displayed.

(4) In the above embodiment, although in a belt-like image CD, a value of an on-velocity Von and a value of an off-velocity Voff were displayed by numerical values, in the similar manner, a value of the key position image KP, a value of the hammer position image HP or a value of the pedal behavior image 730 may be displayed. At this time, by extracting a point where the measurement value caused a predetermined change, a measurement value of this point may be displayed.

(5) In the above embodiment, although the key position image KP and the hammer position image HP were linear images that show the measurement values with a position in a vertical direction in the region BN, any image may be used, as long as an image is displayed by a method that may visually recognize a variation of the measurement value such as an image (linear or belt-like) that expresses the measurement value by the color change.

(6) In the above embodiment, an image due to a color change such as the pedal behavior image 730 displayed spreading over the region BN corresponding to a plurality of keys may be a behavior of an operator such as a wheel controller in place of the behavior of the pedal. That is, an image displayed spreading over the region BN corresponding to a plurality of keys is not limited to one that displays a behavior of the pedal, as long as a behavior of the operator for inputting an instruction having no relation with a pitch.

(7) In the above embodiment, although the pedal behavior image 730 was displayed responding to the behavior of the pedal, a member coordinating with the pedal, for example, one that displays the behavior of the damper may be used.

(8) In the above embodiment, although the key behavior image 770 included the key position image KP, the hammer position image HP and the belt-like image CD, when at least any one of these is contained, a part of the image may not be contained.

(9) In the above embodiment, although the key position image KP was displayed based on a position of the key, it may be displayed based on a physical amount showing a behavior such as a speed or an acceleration. The situation is the same also for the hammer position image HP and the pedal behavior image 730.

(10) In the performance result region 700 in the above embodiment, when the relationship of at least two of the key position image KP, the hammer position image HP, the belt-like image CD, and the pedal behavior image 730 satisfy the predetermined condition, at a position that corresponds to the relation that satisfies the condition, a predetermined image may be displayed.

(11) The analysis support function 10 in the above embodiment may not have other constitutions as long as at least the data acquisition part 101 and the display data generation part 105 are provided.

REFERENCE SIGNS LIST

1 . . . analysis support device, 10 . . . analysis support function, 11 . . . control unit, 13 . . . storage unit, 15 . . . operation unit, 17 . . . display unit, 19 . . . interface, 30 . . . measurement device, 32 . . . key position measurement unit, 33 . . . pedal position measurement unit, 34 . . . hammer position measurement unit, 35 . . . data output device, 40 . . . sound recording device, 50 . . . piano, 52 . . . key, 53 . . . pedal, 54 . . . hammer, 55 . . . string, 58 . . . damper, 101 . . . data acquisition part, 103 . . . specific part, 105 . . . display data generation part, 111 . . . playback position instruction part, 113 . . . playback part, 121 . . . musical score acquisition part, 351 . . . data generation part, 353 . . . interface, 700 . . . performance result region, 710 . . . keyboard image, 730 . . . pedal behavior image, 750 . . . instruction image, 770 . . . key behavior image, 800 . . . musical score region, 850 . . . instruction image, 900 . . . control icon region.

What is claimed is:

1. A data generation device comprising:

a memory configured to store executable instructions; and processing circuitry configured to execute the executable instructions stored in the memory to thereby realize:

an acquisition part configured to acquire measurement data that corresponds to measurement values, obtained in chronological order, representing one of a plurality of positions including at least one position between a rest position and an end position of a key or one of a plurality of positions contained within a movable range of a member coordinating with the key for each of a plurality of keys;

a data generation part configured to generate display data for displaying a screen showing the measurement values corresponding to each of the plurality of keys based on the acquired measurement data such that the measurement values corresponding to each of the plurality of keys are respectively displayed on a plurality of belt-like regions in the screen respectively corresponding to the plurality of keys along a time axis; and a specifying part configured to specify a period from a key depression to a key release based on the measurement values, wherein the data generation part is further configured to generate display data such that the period from the key depression to the key release corresponding to the plurality of keys is displayed on the plurality of belt-like regions along the time axis.

2. The data generation device according to claim 1, wherein a change of a measurement value in a first belt-like region among the plurality of belt-like regions is represented by a positional change in a width direction in the first belt-like region.

3. The data generation device according to claim 1, wherein a change of a measurement value in a first belt-like region among the plurality of belt-like regions is represented by a color change in the first belt-like region.

4. The data generation device according to claim 1, wherein a change of a measurement value in a first belt-like region among the plurality of belt-like regions is represented by an occupancy change of an image in a width direction of the first belt-like region.

5. The data generation device according to claim 1, wherein measurement values representing both of the key and the member coordinating with the key are generated for display on the screen.

6. The data generation device according to claim 1, wherein the data generation part is further configured to generate display data for displaying a musical score, a first instruction image for instructing a position on the time axis on the screen, and a second instruction image for instructing a position in the musical score corresponding to the position.

7. The data generation device according to claim 1, wherein the acquisition part further acquires second measurement data that corresponds to second measurement values, obtained in chronological order, corresponding to a behavior of an operator, the second measurement values are displayed along the time axis spreading over a region corresponding to a plurality of keys on the screen, and a change of the second measurement value is represented by a color change.

8. The data generation device according to claim 1, wherein the measurement values are displayed before and after the period from the key depression to the key release on the plurality of belt-like regions along the time axis.

9. A non-transitory computer-readable storage medium having a program stored thereon, the program causing a computer to:

acquire measurement data that corresponds to measurement values, obtained in chronological order, representing one of a plurality of positions including at least one position between a rest position and an end position of one of a plurality of positions contained within a movable range of a key or a member coordinating with the key for each of a plurality of keys; and generate display data for displaying a screen showing the measurement values corresponding to each of the plurality of keys along a time axis based on the acquired measurement data such that the measurement values corresponding to each of the plurality of keys are respectively displayed on a plurality of belt-like regions in the screen respectively corresponding to the plurality of keys along a time axis; and specify a period from a key depression to a key release based on the measurement values wherein in the generate display data for displaying the screen, display data for displaying the period from the key depression to the key release corresponding to the plurality of keys on the plurality of belt-like regions along the time axis is generated and displayed.

10. The non-transitory computer-readable storage medium according to claim 9, wherein a change of a measurement value in a first belt-like region among the plurality of belt-like regions is represented by a positional change in a width direction in the first belt-like region.

11. The non-transitory computer-readable storage medium according to claim 9, wherein a change of a measurement value in a first belt-like region among the plurality of belt-like regions is represented by a color change in the first belt-like region.

12. The non-transitory computer-readable storage medium according to claim 9, wherein a change of a measurement value in a first belt-like region among the plurality of belt-like regions is represented by an occupancy change of an image in a width direction of the first belt-like region.

13. The non-transitory computer-readable storage medium according to claim 9, wherein measurement values representing both of the key and the member coordinating with the key are generated for display on the screen.

14. The non-transitory computer-readable storage medium according to claim 9, wherein display data is further generated for displaying a musical score, a first instruction image for instructing a position on the time axis on the screen, and a second instruction image for instructing a position in the musical score corresponding to the position.

15. The non-transitory computer-readable storage medium according to claim 9, wherein the program further causes the computer to:

acquire second measurement data that corresponds to second measurement values, obtained in chronological order, corresponding to a behavior of an operator, wherein the second measurement values are displayed along the time axis spreading over a region corresponding to a plurality of keys on the screen; and a change of the second measurement value is represented by a color change.

16. The non-transitory computer-readable storage medium according to claim 9, wherein the measurement values are displayed before and after the period from the key depression to the key release on the plurality of belt-like regions along the time axis.

17. A data generation device comprising:

a memory configured to store executable instructions; and processing circuitry configured to execute the executable instructions stored in the memory to thereby realize:

an acquisition part configured to acquire measurement data that corresponds to measurement values representing one of a plurality of positions contained within a movable range of an operator;

a data generation part configured to generate display data for displaying a screen showing information related to a movement of a plurality of keys along a time axis based on the acquired measurement data such that the measurement values corresponding to each of the plurality of keys are respectively displayed on a plurality of belt-like regions in the screen respectively corresponding to the plurality of keys along a time axis, and the measurement values being shown along the time axis by a color change in a on the plurality of belt-like regions; and a specifying part configured to specify a period from a key depression to a key release based on the measurement values, wherein the data generation part is further configured to generate display data such that the period from the key depression to the key release corresponding to the plurality of keys is displayed on the plurality of belt-like regions along the time axis.

18. A non-transitory computer-readable storage medium having a program stored thereon, the program causing a computer to:

acquire measurement data that corresponds to measurement values representing one of a plurality of positions contained within a movable range of an operator;

generate display data for displaying a screen showing information related to a movement of a plurality of keys along a time axis based on the acquired measurement data such that the measurement values corresponding to each of the plurality of keys are respectively displayed on a plurality of belt-like regions in the screen respectively corresponding to the plurality of keys along a time axis, and the measurement values being shown along the time axis by a color change on the plurality of belt-like regions; and specify a period from a key depression to a key release based on the measurement values wherein in the generate display data for displaying the screen, display data for displaying the period from the key depression to the key release corresponding to the plurality of keys on the plurality of belt-like regions along the time axis is generated and displayed.

* * * * *